US012768177B2

(12) United States Patent
Ruland

(10) Patent No.: US 12,768,177 B2
(45) Date of Patent: Oct. 20, 2026

(54) CUTTING AND LAYING AID FOR CUTTING TO SIZE AND LAYING FLOORBOARDS IN A HERRINGBONE PATTERN

(71) Applicant: VAN DER VLIS DESIGN GMBH, Bonn (DE)

(72) Inventor: Carl Ruland, Bonn (DE)

(73) Assignee: VAN DER VLIS DESIGN GMBH, Bonn (DE)

( * ) Notice: Subject to any disclaimer, the term of this patent is extended or adjusted under 35 U.S.C. 154(b) by 124 days.

(21) Appl. No.: 18/015,450

(22) PCT Filed: Jul. 9, 2021

(86) PCT No.: PCT/EP2021/069189

§ 371 (c)(1),
(2) Date: Jan. 10, 2023

(87) PCT Pub. No.: WO2022/008727

PCT Pub. Date: Jan. 13, 2022

(65) Prior Publication Data

US 2023/0279674 A1 Sep. 7, 2023

(30) Foreign Application Priority Data

Jul. 10, 2020 (DE) ..... 10 2020 118 329.1

(51) Int. Cl.
*E04F 21/00* (2006.01)
*E04F 21/22* (2006.01)

(52) U.S. Cl.
CPC ..... *E04F 21/22* (2013.01); *E04F 21/0076* (2013.01)

(58) Field of Classification Search
CPC ..... E04F 21/0076; E04F 21/20; E04F 21/22
(Continued)

(56) References Cited

U.S. PATENT DOCUMENTS 4,263,717 A * 4/1981 Twining ..... E04F 21/22 33/527
4,827,625 A * 5/1989 Le Moal ..... E04F 21/22 33/562

(Continued)

FOREIGN PATENT DOCUMENTS

AU 2002341477 A1 * 6/2003
CA 2414561 A1 * 6/2004 ..... B25H 7/02

(Continued)

OTHER PUBLICATIONS

"TheFlooringForum", Floorskills Herringbone Template, Oct. 10, 2019, ; https://www.youtube.com/watch?app=desktop&v=NuTolY7lxGO (Year: 2019).*

(Continued)

*Primary Examiner* — Ryan D Kwiecinski
(74) *Attorney, Agent, or Firm* — CANTOR COLBURN LLP

(57) ABSTRACT

A cutting and laying aid for cutting and laying floorboards of a floor covering includes floorboards in a herringbone pattern. The cutting and laying aid is a flat body having a flat body length and a flat body width. A method for cutting and laying floorboards when laying them in a herringbone pattern and a use of a cutting and laying aid are also related. The dimensions of the cutting and laying aid partially correspond to the characteristic dimensions of the floorboards or of the laying pattern. With these dimensions, the periodicity of the laying pattern is exploited to shorten the floorboards in the region of the laying area boundary to the required lengths or cut them to length. Contours of a laying area boundary, particularly a laying area edge, are transferred onto floorboards while saving a considerable amount of time and making the floorboard cutting of more precise and easier.

10 Claims, 4 Drawing Sheets

Figure 1:
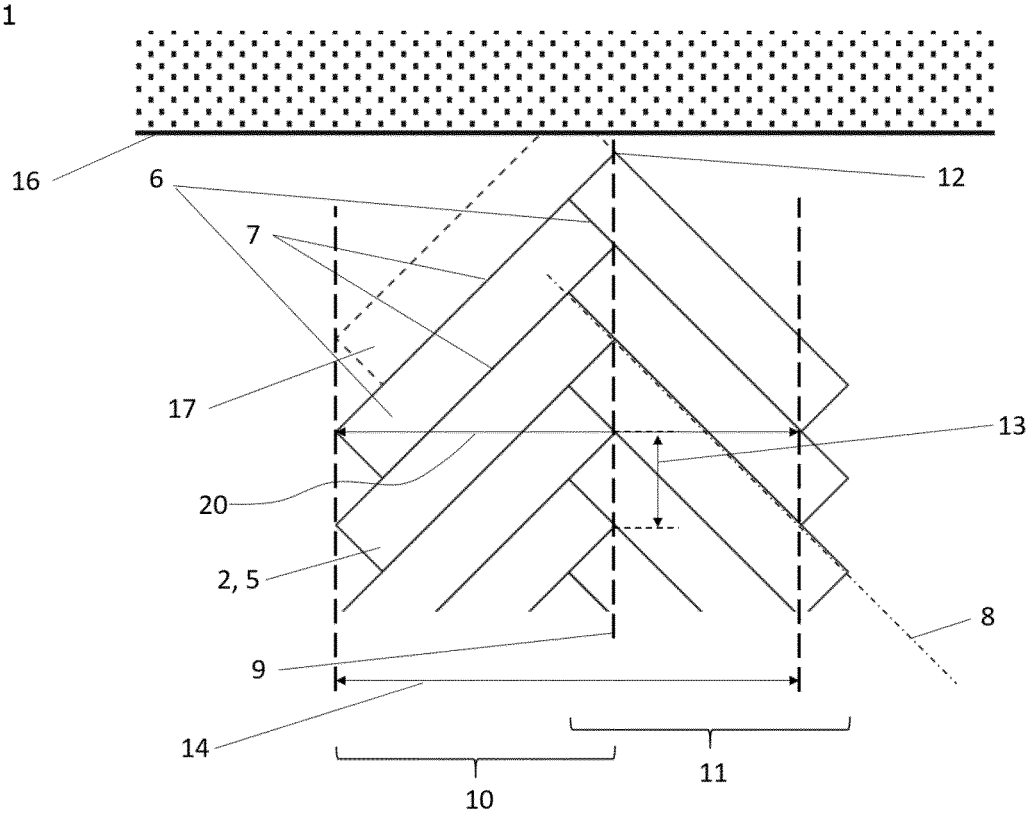

(58) Field of Classification Search
USPC ..... 33/526, 527
See application file for complete search history.

(56) References Cited

U.S. PATENT DOCUMENTS

| | | | | | |
|---|---|---|---|---|---|
| 4,930,225 | A * | 6/1990 | Phillips | E04F 21/0076 | 33/526 |
| 5,020,233 | A * | 6/1991 | Syken | B43L 7/12 | 33/456 |
| 5,586,395 | A * | 12/1996 | Malczewski | B25H 7/00 | 33/500 |
| 6,195,904 | B1 * | 3/2001 | Greer | E04F 21/0076 | 33/526 |
| 6,209,213 | B1 * | 4/2001 | Moe | G01B 3/004 | 33/538 |
| 6,401,584 | B1 * | 6/2002 | Rowe | G01B 3/56 | 83/581 |
| 6,481,112 | B1 * | 11/2002 | White | E04F 21/0076 | 33/527 |
| 6,523,272 | B1 * | 2/2003 | Morales | E04F 21/0076 | 33/526 |
| 6,578,279 | B1 * | 6/2003 | Moon | E01C 23/01 | 33/526 |
| 6,729,035 | B1 * | 5/2004 | Carrillo | G01B 3/14 | 33/526 |
| D869,967 | S * | 12/2019 | Turley | D10/65 | |
| 11,434,648 | B2 * | 9/2022 | Tawil | E04D 15/02 | |
| 11,728,631 | B1 * | 8/2023 | Olive | B23B 49/02 | 33/519 |
| 11,951,645 | B2 * | 4/2024 | Schaller | E04G 21/1891 | |
| 2003/0033724 | A1 * | 2/2003 | Barbosa | E04F 21/0076 | 33/526 |
| 2003/0101674 | A1 * | 6/2003 | Pervan | E04F 15/02033 | 52/592.1 |
| 2003/0164078 | A1 * | 9/2003 | Hiland, Jr. | B25H 1/0078 | 83/522.19 |
| 2004/0060183 | A1 * | 4/2004 | Moas | E04F 21/20 | 33/526 |
| 2005/0115091 | A1 * | 6/2005 | Harris | E04F 21/0076 | 33/461 |
| 2006/0032168 | A1 * | 2/2006 | Thiers | E04F 15/02 | 52/592.1 |
| 2006/0123648 | A1 * | 6/2006 | Bailey | E04F 21/0076 | 33/526 |
| 2006/0196139 | A1 * | 9/2006 | Pervan | E04C 2/20 | 52/586.1 |
| 2008/0052937 | A1 * | 3/2008 | Bailey | E04F 21/20 | 33/526 |
| 2008/0172971 | A1 * | 7/2008 | Pervan | E04F 15/04 | 52/591.5 |
| 2008/0209838 | A1 * | 9/2008 | Pervan | E04F 15/02 | 52/309.1 |
| 2009/0235545 | A1 * | 9/2009 | Shapiro | E04F 21/0076 | 33/471 |
| 2010/0252016 | A1 * | 10/2010 | Flude | E04F 21/20 | 125/1 |
| 2020/0284052 | A1 * | 9/2020 | Tawil | E04D 15/02 | |
| 2023/0279674 | A1 * | 9/2023 | Ruland | E04F 21/0076 | 52/747.1 |

FOREIGN PATENT DOCUMENTS

| | | | | |
|---|---|---|---|---|
| CA | 2488074 | A1 * | 5/2006 | B27B 27/06 |
| CN | 111139998 | A * | 5/2020 | E04F 21/0076 |
| DE | 202010016730 | U1 * | 4/2011 | E04F 21/22 |
| EP | 2466033 | A1 * | 6/2012 | E04F 21/0076 |
| GB | 2574694 | A * | 12/2019 | B25H 7/02 |
| NO | 309734 | B1 * | 3/2001 | E04F 21/20 |
| WO | WO-2005054599 | A1 * | 6/2005 | E04F 15/02 |
| WO | WO-2022008727 | A1 * | 1/2022 | E04F 21/0076 |

OTHER PUBLICATIONS

Trade Discount Shop, Oct. 10, 2019; https://www.tradediscountshop.co.uk/shop/herringbone-set-up-and-scribing-plate/ (Year: 2019).*

English Tranlastion of International Search Report for International Application No. PCT/EP2021/069189, International Filing Date Jul. 9, 2021, Date of Mailing Nov. 4, 2021, 2 pages.

English Tranlastion of Written Opinion for International Application No. PCT/EP2021/069189, International Filing Date Jul. 9, 2021, Date of Mailing Nov. 4, 2021, 8 pages.

* cited by examiner

CUTTING AND LAYING AID FOR CUTTING TO SIZE AND LAYING FLOORBOARDS IN A HERRINGBONE PATTERN

CROSS-REFERENCE TO RELATED APPLICATIONS

The present application is a 35 U.S.C. § 371 National Stage patent application of International patent application PCT/EP2021/069189, filed on 9 Jul. 2021, which claims priority to German patent application 102020118329.1, filed on 10 Jul. 2020.

TECHNICAL FIELD

The present disclosure relates to a cutting and laying aid for cutting and laying floorboards of a floor covering composed of a plurality of floorboards, wherein the floorboards are being laid in a herringbone pattern. To this end, the cutting and laying aid is configured as a flat body whose dimensions are at least partially derived from correspondingly characteristic dimensions of the floorboards or of the herringbone pattern. The disclosure further relates to a method for cutting and laying floorboards when laying the floorboards in a herringbone pattern using the cutting and laying aid proposed with the disclosure.

BACKGROUND

A herringbone pattern is understood to be a geometric arrangement of individual elements, such as floorboards, paving stones, bricks or the like, which are laid in rows at a 45-degree angle with an alternating sign along a laying axis. The pattern thus created resembles a fish skeleton with its bones, from which the name herringbone pattern is derived.

When laying a floor covering of floorboards in a herringbone pattern, the floorboards generally have to be adapted to the contour of the laying surface at the laying area boundary (e.g. a wall or an end trim). This is usually done by measuring the lengths and angles of the gap to be filled and then transferring the measurements onto the floorboard. Depending on the type of the floorboards used, they are then sawed, cut or scored and broken along the transferred contour. Usually, measuring equipment such as a folding rule is used in combination with a simple goniometer in order to capture and transfer the contour.

Variable, segmented templates, by means of which the position and shape of, for example, cutouts for heating pipes on the floorboard can be determined, are commonly used for particularly complex contours. However, only smaller contours can be captured with segmented templates, which is why they are unsuitable for cutting to length complete floorboards.

Irrespective of the measuring equipment used, there is always the risk that measuring errors and measuring inaccuracies distort the transferred contour. Moreover, when laying the floor covering, a not inconsiderable part of the total time used is taken up by capturing and transferring the contours.

SUMMARY

Accordingly, the disclosure provides a cutting and laying aid which, compared with the prior art, enables the user to transfer contours of a laying area boundary, particularly of a laying area edge, onto floorboards while saving a considerable amount of time and, at the same time, make the cutting of floorboards more precise and easier. The same advantage is covered by the method, which is proposed with the disclosure, for cutting and laying floorboards when laying the floorboards in a herringbone pattern using the cutting and laying aid proposed with the disclosure. This is also covered by providing the inventive use of a cutting and laying aid in a method for cutting and laying floorboards when laying the floorboards in a herringbone pattern.

This is achieved by providing a cutting and laying aid having the features of an independent claim, by a method having the features of another independent claim, and by a use having the features of another independent claim.

It must be noted that the features cited individually in the claims can be combined with each other in any technologically meaningful manner (also across the boundaries of categories, such as method and device) and represent other embodiments of the disclosure. The description, in particular in connection with the figures, additionally characterizes and specifies the disclosure.

It may also be noted that a conjunction "and/or" used hereinafter, which is situated between two features and links them to each other, should always be interpreted such that, in a first embodiment of the subject matter according to the disclosure, only the first feature may be provided, in a second embodiment of the subject matter according to the disclosure, only the second feature may be provided, and in a third embodiment of the subject matter according to the disclosure, both the first and the second feature may be provided.

What is essential to the disclosure is that the dimensions of the cutting and laying aid partially correspond to the characteristic dimensions of the floorboards or of the laying pattern. By means of these dimensions, the periodicity of the laying pattern is exploited to shorten the floorboards in the region of the laying area boundary to the required lengths or cut them to length. A laying area boundary is to be understood to be a laying area edge, e.g. a wall or an end trim.

In an inventive cutting and laying aid for cutting and laying floorboards of a floor covering composed of a plurality of floorboards in a herringbone pattern, the cutting and laying aid is configured as a flat body, the flat body having a flat body length and a flat body width. During use, the flat body extends in a laying plane of the floor covering.

In relation to the laying plane, a floorboard to be laid comprises a substantially rectangular floorboard upper side delimited by two opposite floorboard end sides and floorboard long sides, respectively, wherein the floorboard end sides are shorter than the floorboard long sides and a floorboard longitudinal axis extends parallel to the floorboard long sides.

The herringbone pattern comprises floorboards disposed along a laying axis in at least two laying rows, wherein the floorboards of a first laying row are disposed with an angle of the floorboard longitudinal axis to the laying axis of +45° and the floorboards of a second laying row with an angle of the floorboard longitudinal axis to the laying axis of −45° and the floorboards of a respective laying row, with respect to a respectively adjacent floorboard of the respective laying row, are offset along the floorboard longitudinal axis by one length of the end side in each case, wherein one floorboard long side of a floorboard of a laying row in each case abuts at least partially against a floorboard long side of an adjacent floorboard of the same laying row, and a corner of the floorboard upper side of each floorboard lies on the laying axis.

The cutting and laying aid is characterized in that the flat body width of the cutting and laying aid corresponds to the sum of a first characteristic dimension of the floorboard and a first joint width.

A flat body is understood to be a substantially three-dimensional cuboid whose flat body length and flat body width are significantly greater than its flat body height. In the laid state of the floorboard, the flat body long sides and flat body short sides corresponding to the flat body length and flat body width extend in a laying plane substantially defined in a laying surface on which the floor covering is to be laid.

The floorboards are substantially cuboid and thus comprise an upper and a lower side, two end sides and two long sides as well as the edges thereof. The end sides are opposite each other, as are the long sides. The upper side and lower side are also disposed opposite each other. The upper side is of particular importance for laying the floor covering, so that the present nomenclature of the "end sides" and "long sides" of the cuboid refers to the upper side. A floorboard longitudinal axis extends parallel to the long sides of the floorboard. The points of intersection of the end sides with the long sides form the corners of the upper side of the floorboards. The floorboards do not necessarily have to have smooth sides or surfaces but may be broken by groove and tongue elements. The sides of the floorboards may also have snap-in connections as they are widely used in floor coverings, so that the cuboid appearance of the floorboards may deviate greatly. For technical reasons, grooves are also often applied to the lower side, or several edges of the cuboid are provided with a chamfer, so that a deviation from the contours of a cuboid may take place also in this case.

Generally, the herringbone pattern comprises several laying rows composed alternatingly of floorboards at an angle of +45° and −45° (relative to the laying axis). A periodic pattern resulting therefrom may be continued indefinitely along and transversely to the laying axis, so that the herringbone pattern may be composed of any number of laying rows with any length. The cutting and laying aid may be used for all adjacent laying rows created in this periodic manner.

In this case, the first characteristic dimension is derived from the geometric measurements of the floorboard used and determined in combination with a joint width. In this case, the joint width relates to a region of the floor covering not covered by floorboards. Generally, these are those regions in which an expansion joint for the floor covering has to be provided, so that the joint width may correspond to the expansion joint width. Generally, expansion joints are located in the edge region of the floor covering, or divide larger floor areas into several small areas in which the floor covering is then laid separately. However, it may also make sense for the first joint width to be set to zero, for example, if no joint width is required. In this case, the flat body width corresponds only to the first characteristic dimension.

In practical application, provided the laying axis has an angle of 45° to 135° to the laying area boundary, that is, for example, if the floorboards are laid along the laying axis in a laying row and the laying row abuts against the wall in the direction of laying, the cutting and laying aid is used as follows:

Floorboards not cut to length are laid in a laying row in a herringbone pattern until no further floorboards that are not cut to length can be laid in the laying row because of the laying area boundary (e.g. a wall). The next floorboard to be laid in the laying row is the laid down on the last laid floorboard (before the laying area boundary), and the cutting and laying aid is placed on the floorboard to be laid. In the process, the cutting and laying aid is placed with its flat body long side against the wall. The contour of the cutting and laying aid is now transferred onto the floorboard to be laid. This contour corresponds to a projected contour of the wall. The floorboard to be laid is then cut to length along the transferred contour, so that, adapted to the wall, it can be laid further in the herringbone pattern.

Provided an orthogonal of the laying axis has an angle of 45° to 135° to the laying area boundary, that is, for example, if the laying rows extend substantially parallel to the wall and the floorboards of another laying row all have to be shortened (or cut to length), the cutting and laying aid is used as follows:

A first laying row is laid in the vicinity of the wall and a second laying row is laid adjacent to the first laying row on the side of the first laying row facing away from the wall. The floorboards of a laying row between the wall and the first laying row all need to be shortened for laying. To this end, a floorboard to be shortened is placed on a floorboard of the second laying row (relative to the laying area boundary) which is placed within the herringbone pattern at the same level as the floorboard (relative to the laying axis) to be laid. The cutting and laying aid is then disposed on the floorboard to be laid in such a way that the cutting and laying aid abuts with its flat body short side against the wall. The contour of the cutting and laying aid is now transferred onto the floorboard to be laid and the latter is cut to length along the transferred contour, so that the cut-to-length floorboard, adapted to the laying area boundary, can be laid in the herringbone pattern.

The advantageous embodiments specified in the dependent claims and other advantageous (or possible) embodiments of the cutting and laying aid proposed with the disclosure are described in detail below.

According to a first embodiment of a cutting and laying aid proposed with the disclosure, the first characteristic dimension of the floorboard may correspond to a length of a diagonal extending at an angle of 45° to the floorboard longitudinal axis and across the floorboard upper side. This diagonal corresponds to the length over which the floor covering extends, for each floorboard, in the direction laying axis, and thus constitutes a characteristic dimension of the floorboard and the floor covering or the laying pattern. Geometrically, this dimension is directly derived from the floorboard by determining the length of a diagonal at an angle of 45° to the floorboard longitudinal axis.

According to another embodiment of a cutting and laying aid proposed with the disclosure, the flat body length of the cutting and laying aid may correspond to the sum of a second characteristic dimension of the herringbone pattern and a second joint width. The fact that the herringbone pattern is not symmetrical along the laying axis and its transverse axis results in different laying situations in edge regions of the floor covering in the direction of the laying axis and the transverse axis thereof. This may provide a reason for the necessity for a second characteristic dimension for determining the geometry and size of the cutting and laying aid. As was already explained above, a joint width also needs to be taken into account for this purpose, in order to determine the flat body length. Since the joint widths in the edge region in the direction of the laying axis and in the edge region transverse thereto need not be the same, a second joint width may be used for calculating the flat body length. However, it may also make sense for the second joint width to be set to zero, for example, if no joint width is provided. In this case, the flat body length corresponds only to the second characteristic dimension.

According to another embodiment of the cutting and laying aid proposed with the disclosure, the second characteristic dimension may correspond to the length of a connecting line, which extends orthogonally to the laying axis, between an outermost corner of the floorboard end side of a floorboard 2 laid in a first laying row and an—with respect to the laying axis—innermost corner of the floorboard end side of a floorboard laid in the second laying row in the laying plane. Both the above-mentioned outermost corner and the innermost corner in this case are not located on the laying axis but on axes offset parallel thereto.

Using the above-defined second characteristic dimension as a basis is useful for laying another laying row next to the laying rows already laid, in which already the first floorboards, because of a laying area boundary, have to be cut directly, when already uncut floorboards could not be previously laid in the same laying row.

According to another embodiment of a cutting and laying aid proposed with the disclosure, the first and/or second joint widths may be less than 20 mm. The joint width is determined on the basis of the properties of the finished floor covering. Generally, the joint width corresponds to the width of an expansion joint width whose width is below 20 mm in most floor coverings. Preferably, the joint width is less than 15 mm and further preferably less than 10 mm and greater than 6 mm. It may make sense to reduce the joint width to a range of 2 to 6 mm or to limit the range further towards smaller dimensions. Preferably, the joint width is then in a range of 0 to 4 mm.

According to another embodiment of a cutting and laying aid proposed with the disclosure, the first and second joint widths may substantially have the same dimensions. In most cases, no distinction has to be made between different joint widths, so that it is a viable option to dimension the first and second joint widths to the same measurements.

According to another embodiment of a cutting and laying aid proposed with the disclosure, the cutting and laying aid may be configured such that the floor covering can be laid both with a joint width greater than zero and with a joint width equal to zero. With such a configuration of the cutting and laying aid, the floor covering may be laid with and without a joint width, i.e. with or without an expansion joint. For example, this property may be realized by means of a folding edge whose position is chosen in such a way that the dimensions of the cutting and laying aid are reduced to the two characteristic dimensions. Another option is the incorporation of cutouts in the cutting and laying aid for scribing or cutting the floorboard at the level of the characteristic dimensions, wherein the outer edges of the cutting and laying aid, for example, may serve for scribing or cutting the floorboard at the level of the characteristic dimensions plus the joint width.

According to another embodiment of the cutting and laying aid proposed with the disclosure, the cutting and laying aid may be made from a material having sufficient ruggedness so that the cutting and laying aid can be used as a guide for a cutting tool for cutting the floorboards. For this purpose, for example, the height of the flat body perpendicular to the laying plane may be chosen such that the side surface thus created may serve as a contact surface for a knife or saw. A cutout in the cutting and laying aid in which such a tool may be guided is also conceivable. The crucial point is in that case that the material from which the cutting and laying aid is made has a sufficient mechanical ruggedness with respect to the tool used, or that the guide is configured in such a way that the cutting and laying aid is not damaged.

According to another embodiment of a cutting and laying aid proposed with the disclosure, the cutting and laying aid may have a guide rail for a tool, preferably for a cutting and/or marking tool. A guide rail means a device guiding the movement of a tool for scribing and/or cutting the floorboards along a predefined path.

The guide rail may also be configured in such a way that it is not the flat body width or flat body length that correspond to the characteristic dimension plus the joint width but, for example, a distance from one end of the flat body to a trajectory of a tool cutting edge or scribing tool predetermined by the guide rail. In this way, it is not the dimensions of the cutting and laying aid that are essential for the location at which the floorboard is cut to length, but the position at which the tool for scribing and/or cutting to length is guided with respect to one side of the cutting and laying aid. Accordingly, the distance of the trajectory of the tool from the opposite side of the cutting and laying aid needs to correspond to the respective characteristic dimension plus the joint width.

According to another embodiment of a cutting and laying aid proposed with the disclosure, the cutting and laying aid may be made from plastic, metal, a fiber composite material, a natural substance, textile material and/or a cellulose-based material. When selecting the material of the cutting and laying aid, the future area of use should be taken into account. Different materials are options depending on whether it is to be used with floorboards of plastic, hard wood or paving stones, for instance. A production with plastic, for example, is cost-effective; metal, for instance, is more durable. Composite materials often combine different positive material properties. Cellulose-based materials, such as paper and cardboard, are also an option because they are inexpensive to produce and offer sufficient ruggedness when using a marking tool.

According to another embodiment of a cutting and laying aid proposed with the disclosure, cutting instructions for a user may be depicted on a side of the cutting and laying aid. In order to ensure a proper use of the cutting and laying aid, it may make sense to apply cutting instructions to one side of the cutting and laying aid. For example, this may be done by means of an imprint or an additional element, such as instructions which are printed on paper and foldable and may be attached to the cutting and laying aid. An application of cutting instructions by lamination is also possible.

According to another embodiment of a cutting and laying aid proposed with the disclosure, the cutting and laying aid may be configured for laying and cutting floorboards of wood, plastic, stone, tiles and/or composite material.

According to another embodiment of a cutting and laying aid proposed with the invention, the cutting and laying aid may have a surface coating. Depending on the material used for the cutting and laying aid, a surface coating may improve its properties. In particular, this relates to mechanical ruggedness, resistance against dirt and moisture as well as fire resistance (which is relevant in case of flying sparks from welding or milling devices, for instance). In this case, the surface coating may be applied, for example, as a paint or foil, with other types of application not being excluded.

Preferably, the cutting and laying aid may have a surface coating for reducing surface abrasion. Such a coating can increase life, and at the same time offers protection from undesirable wear. For example, the contour of the flat body may be altered by such wear, which may result in the contour of the laying area boundary being incorrectly transferred onto the floorboard.

According to another embodiment of a cutting and laying aid proposed with the disclosure, the cutting and laying aid may have a folding edge for reducing the dimensions of the cutting and laying aid. Depending on the size of the floorboards, the flat body length of the cutting and laying aid, in particular, may become large and thus unwieldy. Therefore, an option is to configure the cutting and laying aid in a foldable manner. Depending on the material used for the cutting and laying aid, one or more folding edges may be provided for this purpose, or the cutting and laying aid may be divided into several hinged parts. A system than can be plugged together is also conceivable.

According to another embodiment of a cutting and laying aid proposed with the disclosure, the cutting and laying aid may be configured such that the flat body width can be extended by the measure of a first characteristic width or a multiple thereof, and/or that the flat body length can be extended by the measure of a second characteristic width or a multiple thereof. For example, this property may be realized by means of a part the cutting and laying aid that is extendable by folding. This function may be useful if, after the first floorboard cut to length, a second floorboard following in the laying row needs to be cut to length. In this case, the second floorboard to be cut to length can again be placed on the scribing position of the first cut-to-length cut to length in order to transfer the contour of the laying area boundary. This saves time because with a cutting and laying aid without this function, the second floorboard to be cut to length would first have to be shortened in a rough manner in order to then place it on the first cut-to-length and already laid floorboard for transferring the contour. Such a folding function may be provided on the cutting and laying aid in several instances, so that further floorboards to be cut to length can also be cut to length without having to be shortened in a rough manner beforehand.

According to another embodiment of a cutting and laying aid proposed with the disclosure, the cutting and laying aid may be configured for use in a herringbone pattern with an angle between the laying axis and a laying area boundary of equal to or greater than 45° and equal to or less than 135°.

According to another embodiment of a cutting and laying aid proposed with the disclosure, the cutting and laying aid may be configured for use in a herringbone pattern with an angle between an orthogonal of the laying axis and a laying area boundary of equal to or greater than 45° and equal to or less than 135°.

As was already mentioned, the advantage on which the disclosure is based is also achieved by providing a method for cutting and laying floorboards for laying the floorboards in a herringbone pattern as defined above, using a cutting and laying aid configured in accordance with the disclosure.

According to the method proposed with the disclosure, it is provided that the method comprises, in a first variant of the method, the following steps if the laying axis has an angle of 45° to 135° to the laying area boundary:

First, floorboards not cut to length are laid in a laying row in a herringbone pattern in the direction of a laying area boundary until no further floorboards that are not cut to length can be laid in the laying row because of the laying area boundary. Then, the next floorboard to be laid in the laying row is placed on the last laid floorboard of the side of the laying row facing towards the laying area boundary. Then, the cutting and laying aid is placed on the floorboard to be laid in such a way that the cutting and laying aid abuts with its flat body long side against the laying area boundary. Thereafter, a contour of the cutting and laying aid is transferred onto the floorboard to be laid. Preferably, this is the contour of the cutting and laying aid intersecting with the upper side of the cutting and laying aid. Then, the floorboard to be laid is cut to length along the transferred contour, and the floorboard which is cut to length and to be laid is laid so as to conform to the herringbone pattern.

In a second variant of the method, the method comprises the following steps if an orthogonal to the laying axis has an angle of 45° to 135° to the laying area boundary:

First, floorboards not cut to length are laid so as to conform to a herringbone pattern in the direction of a laying area boundary, wherein a first laying row is laid in the vicinity of the laying area boundary and a second laying row is laid adjacent to the first laying row on the side of the first laying row facing away from the laying area boundary. A floorboard to be laid between the laying area boundary and the first laying row is placed on a floorboard of the second laying row which is placed within the herringbone pattern at the same level as the floorboard to be laid (in relation to the laying axis). Then, the cutting and laying aid is placed on the floorboard to be laid in such a way that the cutting and laying aid abuts with its flat body short side against the laying area boundary. Then, a contour of the cutting and laying aid is transferred onto the floorboard to be laid. Preferably, this is the contour of the cutting and laying aid intersecting with the upper side of the cutting and laying aid. Finally, the floorboard to be laid is cut to length along the transferred contour, and the floorboard which is cut to length and to be laid is laid so as to conform to the herringbone pattern.

Furthermore, the advantage on which the disclosure is based is also achieved by providing a use of a cutting and laying aid configured in accordance with the disclosure in a method for cutting and laying floorboards when laying the floorboards in a herringbone pattern, preferably in a method according to the disclosure. Accordingly, a cutting and laying aid proposed with the disclosure is designed and configured to be used in a method proposed with the disclosure.

BRIEF DESCRIPTION TO THE DRAWINGS

Figure 2:
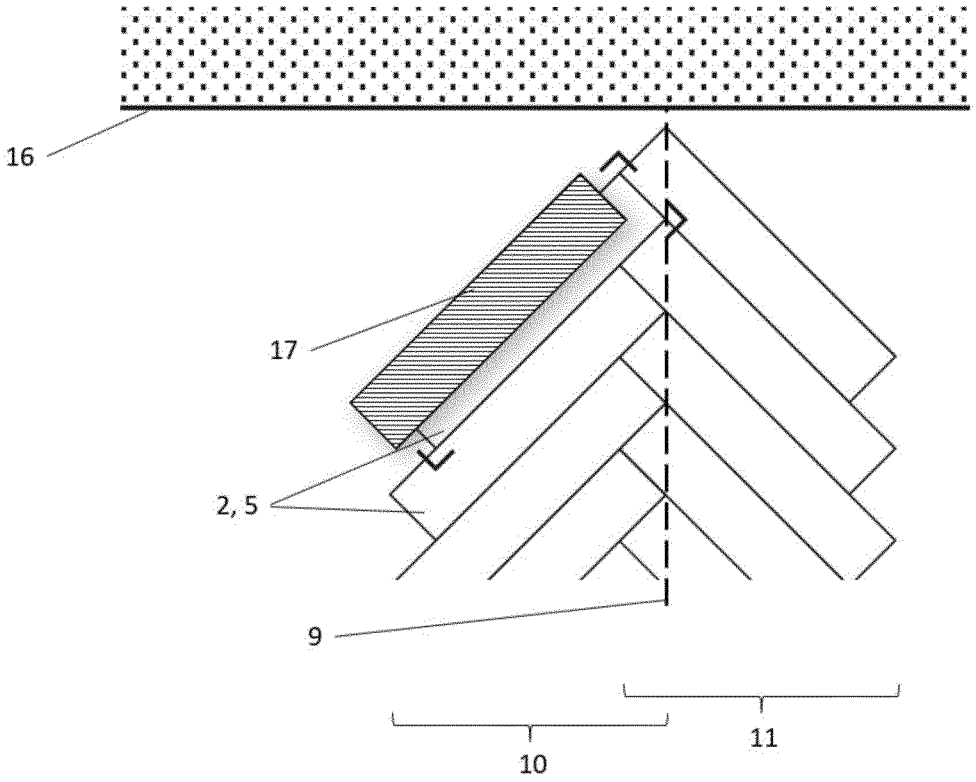
Figure 3:
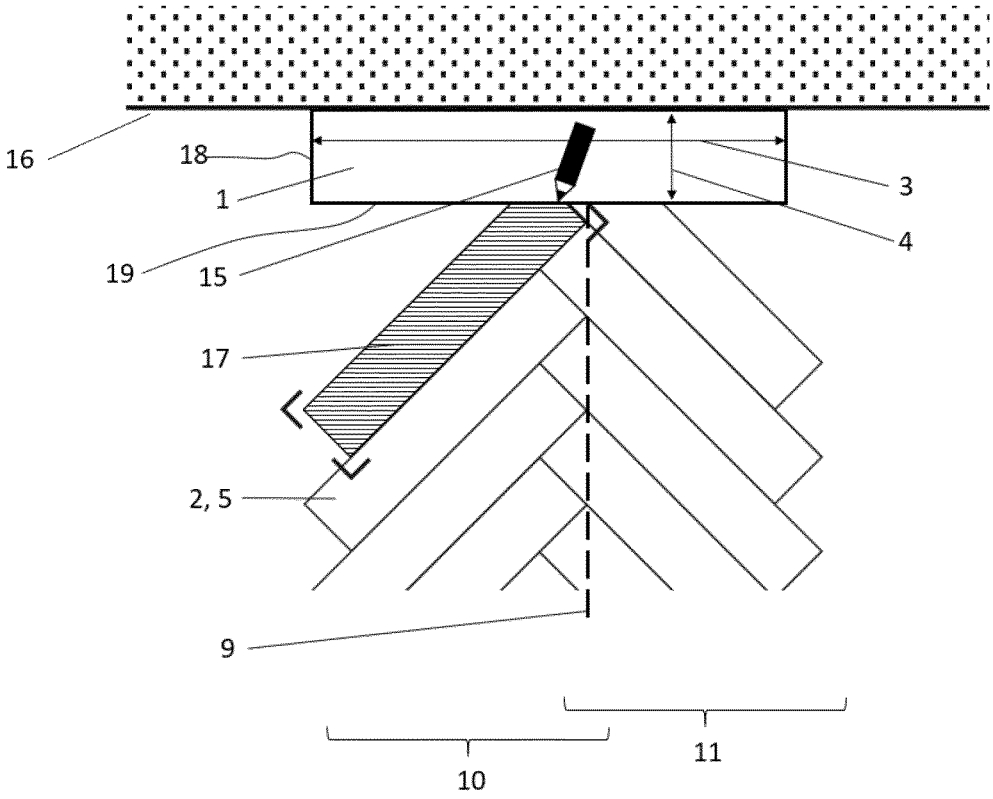
Figure 4:
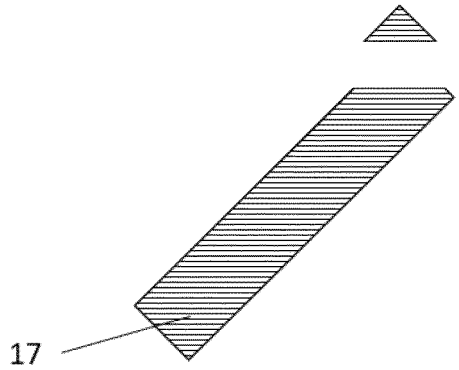
Figure 5:
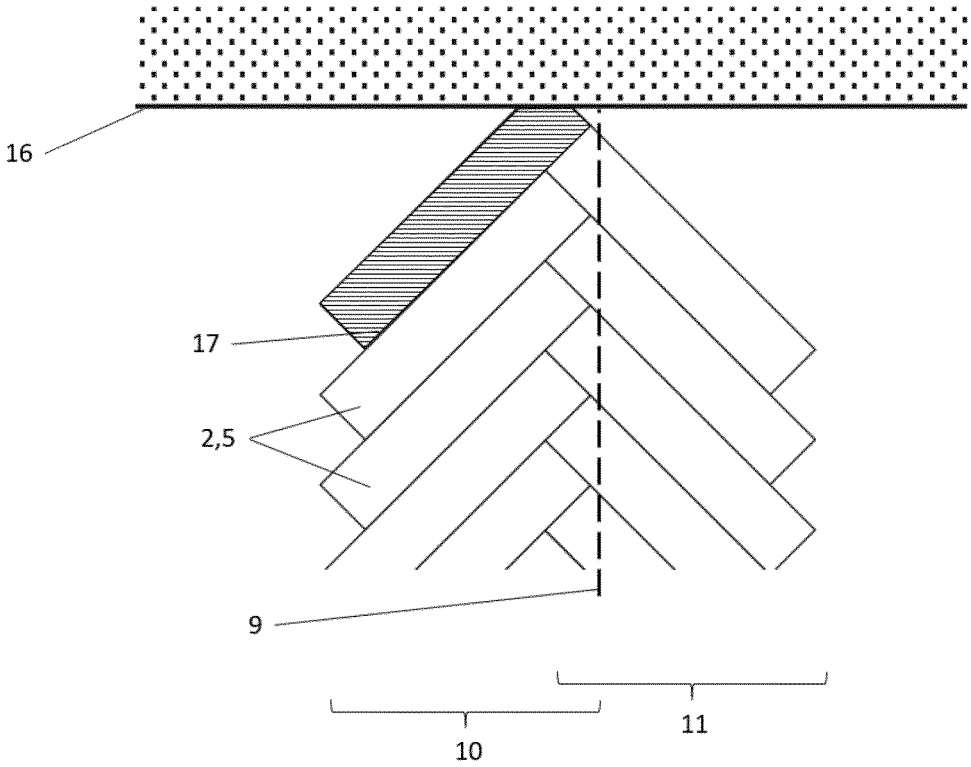
Figure 6:
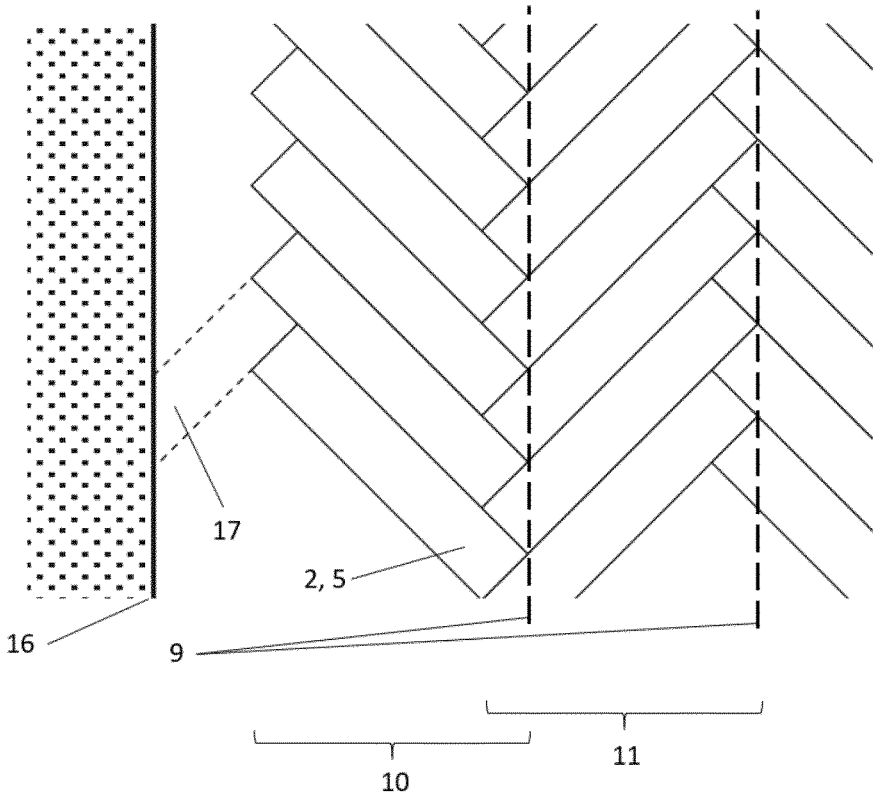
Figure 7:
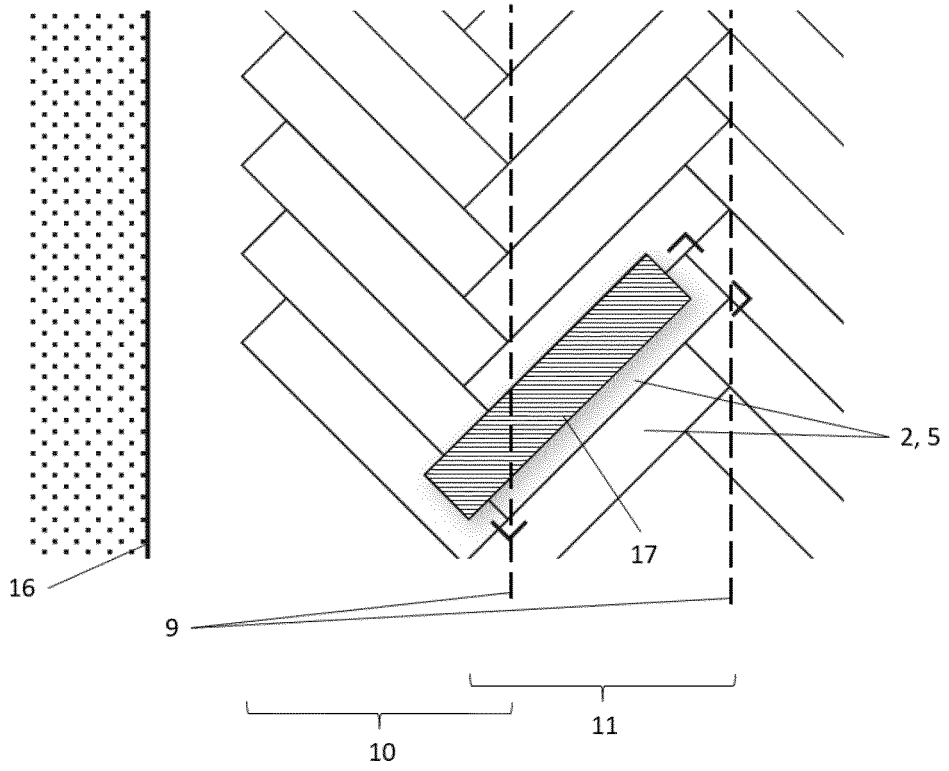
Figure 8:
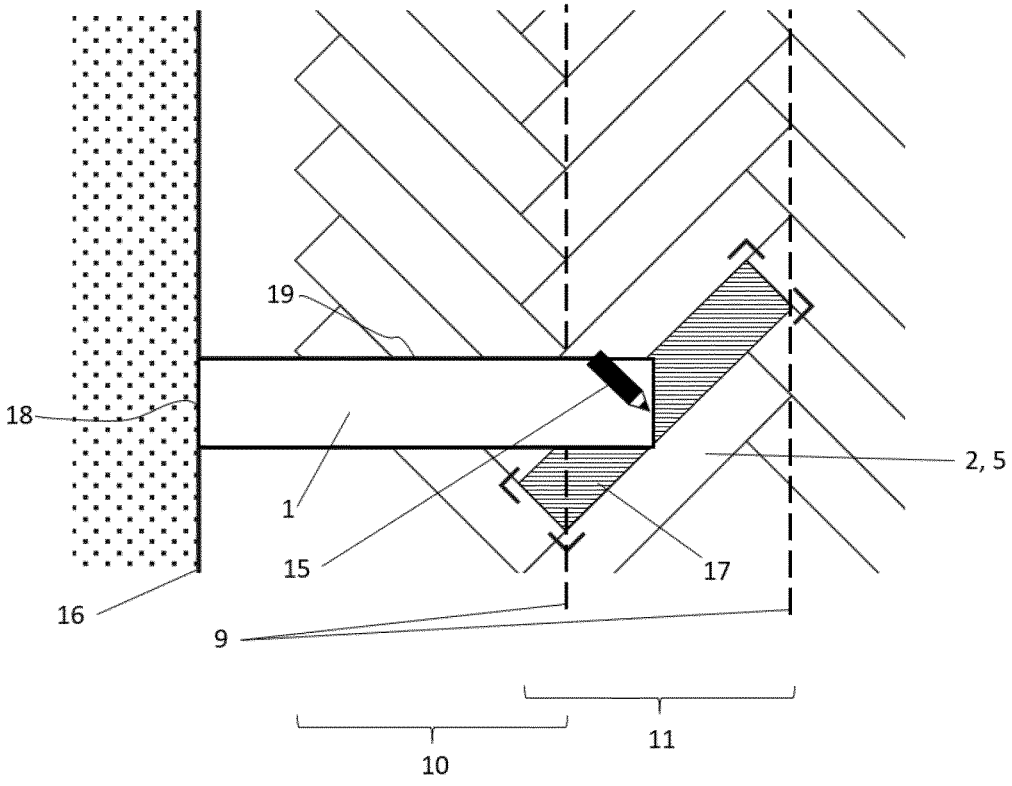

Other advantages and features of the disclosure become apparent from the following description of exemplary embodiments of the disclosure, which shall be understood not to be limiting and which will be explained below with reference to the drawings. These drawings schematically show:

FIG. 1: a partial top view of a floor covering to be laid with a laying area boundary 16 in a first arrangement, wherein the floor covering is laid with a herringbone pattern, and an illustration of a floorboard 17 to be laid, which is to be shortened prior to laying;

FIG. 2: the position into which the floorboard 17 to be laid according to FIG. 1 is to be brought for transferring the contour of the laying area boundary 16;

FIG. 3: the cutting and laying aid 1 in a position for transferring the contour of the laying area boundary 16 onto the floorboard 17 to be laid;

FIG. 4: a floorboard 17 cut to length and to be laid in accordance with the contour of the laying area boundary 16 of FIG. 3, FIG. 5: the laid, cut-to-length floorboard 17 in a laying arrangement according to FIGS. 1-4;

FIG. 6: a partial top view of a floor covering to be laid with a laying area boundary 16 in an alternative arrangement, wherein the floor covering is laid with a herringbone pattern, and an illustration of a floorboard 17 to be laid, which is to be shortened first;

FIG. 7: the position into which the further floorboard 17 to be laid according to FIG. 6 is to be brought for transferring the contour of the laying area boundary 16; and FIG. 8: the cutting and laying aid 1 in a position for transferring the contour of the laying area boundary 16 onto the further floorboard 17 to be laid.

DETAILED DESCRIPTION TO THE DRAWINGS

FIG. 1 shows a top view of a floor covering laid in a herringbone pattern and composed of individual floorboards 2. In the process, the floorboards 2 are arranged and laid in an alternatingly periodic manner at an angle of +45° or −45° along a laying axis 9. In this case, the angle is applied between the floorboard longitudinal axis 8 and the laying axis 9. One corner 12 of the floorboard upper side 5 of each floorboard 2, respectively, is in this case disposed on the laying axis 9, and the floorboard long sides 7 of adjacent floorboards 2 abut against each other. This results in two laying rows 10 and 11, which cannot be continued in the direction of a laying area boundary 16 (which may be a wall, for example) without cutting to length the next floorboards 17 to be laid. The next floorboard 17 to be laid is in this case depicted in dashed lines, it being apparent that the upper corner of the floorboard 17 to be laid (without the floorboard 17 being cut to length) would protrude over the laying area boundary 16, and thus needs to be cut to length for laying the floorboard 17.

The first characteristic dimension 13 and the second characteristic dimension 14, which represent geometric measurements of the floorboards 2 or of the herringbone pattern, are also shown. In this case, the first characteristic 13 corresponds to the diagonal along the laying axis 9 across a floorboard. At the same time, this is also the extent by which the floor covering progresses for each laid floorboard 2 in the direction of the laying axis 9. In contrast, the second characteristic dimension 14 is derived from the herringbone pattern. In this case, the second characteristic dimension 14 corresponds to a length of a connecting line 20, which extends orthogonally to the laying axis 9, between an outermost corner of the floorboard end side 6 of a floorboard 2 laid in a first laying row 10 and an—with respect to the laying axis 9—innermost corner of the floorboard end side 6 of a floorboard 2 laid in the second laying row 11 in the laying plane. Both the above-mentioned outermost corner and the innermost corner in this case are not located on the laying axis 9 but on axes offset parallel thereto.

FIG. 2 indicates the placement position for the floorboard 17 which needs to be realized in order to properly transfer the contour of the laying area boundary 16 onto the floorboard 17 to be laid and cut it to length accordingly by means of the cutting and laying aid 1. In the process, the floorboard 17 to be laid is laid down or placed on the last floorboard 2, which has already been laid, of the same laying row 10 or 11. The floorboard 17 to be laid, which final position is shown in dashed lines in FIG. 1, therefore has to be placed on the last floorboard 2 of the same laying row 10, which is marked in the present case with brackets at the corners of the floorboard 2.

After the floorboard 17 to be laid has been brought into position in accordance with FIG. 3, FIG. 3 also shows the cutting and laying aid 1 in its position of use, so that the contour of the laying area boundary 16 can be transferred onto the floorboard 17 to be laid, wherein the flat body width 4 or the flat body short side 18 of the cutting and laying aid comes into play. In this case, the cutting and laying aid 1 abuts with its flat body long side 19 against the laying area boundary 16. The floorboard 17 to be laid can be scribed and cut to length on the opposite side of the cutting and laying aid 1. The contour is thus transferred at the position at which the floorboard 17 to be laid (or the upper side of the floorboard 17) is intersected by the flat body long side 19.

According to the illustration of FIG. 4, the floorboard 17 to be laid, which is arranged in the herringbone pattern according to FIG. 5, is then cut to length along this transferred contour. The leftover piece that was cut off is not used in laying this floorboard 17 to be laid and is discarded.

In analogy therewith, FIG. 6 shows a different part of the floor covering with a herringbone pattern. Two laying rows 10 and 11 and a further laying row are indicated for this purpose. Several laying axes that are of importance for the respective laying rows 10, 11 are also depicted. In this case a further laying row of floorboards 2 has to be laid next to and to the left of the first two laying rows 10 and 11, wherein no (uncut) floorboards 2 can be laid due to the given measurements and the distance from the laying area boundary 16, but the floorboards 17 to be laid in this row have to be cut to length. By way of example, the floorboard 17 to be laid is depicted in dashed lines and would protrude over the laying area boundary 16. The part of the floorboard 17 to be laid protruding over the laying area boundary 16 therefore needs to be cut off or cut to length for laying the floorboard 17.

In this case, the floorboard 17 to be laid, as shown in FIG. 7, is placed onto an already-laid floorboard 2 two laying rows further to the right and at the same level in the herringbone pattern, for transferring the contour of the laying area boundary 16. The same level in this example means that the position, which is shown in dashed lines in FIG. 6, of the floorboard 17 to be laid is projected orthogonally to the laying axis 9, i.e. in this case even horizontally, and towards the right onto the second laying row 11, marked by brackets at the corners of this floorboard 2.

FIG. 8 finally shows the positioning of the cutting and laying aid 1, whose flat body long side 19 is used for transferring the contour of the laying area boundary 16. To this end, the flat body short side 18 abuts against the laying area boundary 16.

In analogy to the previous process, the floorboard 17 to be laid is then cut to length along the transferred contour of the laying area boundary 16 and laid. In the process, the floorboard 17 to be laid is cut to length in the area of intersection of the flat body short side 18 with the floorboard 2. Also analogously, the process can be carried over to the other boundary areas of the laying plane.

The invention claimed is:

1. A system for cutting and laying floorboards of a floor covering composed of a plurality of floorboards in a herringbone pattern, the system comprises the plurality of floorboards and a cutting and laying aid, wherein the cutting and laying aid is configured as a flat body having a flat body length and a flat body width, wherein each of the plurality of floorboards has, in relation to the laying plane, a substantially rectangular floorboard upper side delimited by two opposite floorboard end sides and floorboard long sides, respectively, wherein the floorboard end sides are shorter than the floorboard long sides and a floorboard longitudinal axis extends parallel to the floorboard long sides, wherein the herringbone pattern comprises floorboards disposed along a laying axis in at least two laying rows, wherein the floorboards of a first laying row are disposed with an angle of the floorboard longitudinal axis to the laying axis of +45° and the floorboards of a second laying row with an angle of the floorboard longitudinal axis to the laying axis of −45° and the floorboards of a respective laying row, with respect to a respectively adjacent floorboard of the respective laying row, are offset along the floorboard longitudinal axis by one length of the end side in each case, wherein one floorboard long side of a floorboard of a laying row in each case abuts at least partially against a floorboard long side of an adjacent floorboard of the same laying row, and a corner of the floorboard upper side of each floorboard lies on the laying axis, wherein the flat body width corresponds to the sum of a first characteristic dimension of the floorboard and a first joint width, wherein the first characteristic dimension of the floorboard corresponds to a length of a diagonal extending at an angle of 45° to the floorboard longitudinal axis and across the floorboard upper side.

2. The system according to claim 1, wherein the flat body length of the cutting and laying aid corresponds to the sum of a second characteristic dimension of the herringbone pattern and a second joint width.

3. The system according to claim 2, wherein the second characteristic dimension corresponds to the length of a connecting line, which extends orthogonally to the laying axis, between an outermost corner of the floorboard end side of a floorboard laid in a first laying row and, with respect to the laying axis, an innermost corner of the floorboard end side of a floorboard laid in the second laying row in the laying plane.

4. The system according to claim 1, wherein the first and/or second joint widths are less than 20 mm and greater than 6 mm.

5. The system according to claim 1, wherein the first and second joint widths have substantially the same dimensions.

6. The system according to claim 1, wherein the cutting and laying aid is made from plastic, metal, a fiber composite material, a natural substance, textile material and/or a cellulose-based material.

7. The system according to claim 1, wherein cutting instructions for a user are depicted on a side of the cutting and laying aid.

8. The system according to claim 1, wherein the cutting and laying aid has a surface coating.

9. The system according to claim 1, wherein the cutting and laying aid is configured so that the flat body width is configured to be extended by the measure of a first characteristic width or a multiple thereof, and/or that the flat body length is configured to be extended by the measure of a second characteristic width or a multiple thereof.

10. A method for cutting and laying floorboards when laying them in a herringbone pattern, using the system configured in accordance with claim 1, wherein the method, in a first variant of the method, includes the following step if the laying axis has an angle of 45° to 135° to the laying area boundary:

a. floorboards are laid in a laying row in a herringbone pattern in the direction of a laying area boundary until no further floorboards are laid in the laying row because of the laying area boundary, b. the next floorboard to be laid in the laying row is placed on the last laid floorboard of the side of the laying row facing towards the laying area boundary, c. the cutting and laying aid is placed on the floorboard to be laid in such a way that the cutting and laying aid abuts with its flat body long side against the laying area boundary, d. a contour of the cutting and laying aid is transferred onto the floorboard to be laid, e. the floorboard to be laid is cut along the transferred contour, f. and the cut floorboard is laid to conform to the herringbone pattern;

and the method includes, in a second variant of the method, the following steps if an orthogonal to the laying axis has an angle of 45° to 135° to the laying area boundary:

g. floorboards are laid so as to conform to a herringbone pattern in the direction of a laying area boundary, wherein a first laying row is laid in the vicinity of the laying area boundary and a second laying row is laid adjacent to the first laying row on the side of the first laying row facing away from the laying area boundary, h. a floorboard to be laid between the laying area boundary and the first laying row is placed on a floorboard of the second laying row which is disposed within the herringbone pattern at the same level as the floorboard to be laid, i. the cutting and laying aid is placed on the floorboard to be laid in such a way that the cutting and laying aid abuts with its flat body short side against the laying area boundary, j. a contour of the cutting and laying aid is transferred onto the floorboard to be laid, k. the floorboard to be laid is cut along the transferred contour, l. and the cut floorboard is laid to conform to the herringbone pattern.

* * * * *